US005129536A

United States Patent [19]

Robinson

[11] Patent Number: 5,129,536

[45] Date of Patent: Jul. 14, 1992

[54] TIME ACTUATED LOCKABLE FOOD STORAGE CONTAINER

[76] Inventor: Roland C. Robinson, 17821 SW. 112th Pl., Miami, Fla. 33157

[21] Appl. No.: 597,369

[22] Filed: Oct. 12, 1990

[51] Int. Cl.[5] ..... B65D 55/00; B65D 45/00; B65D 55/14; B65B 59/00

[52] U.S. Cl. ..... 220/211; 220/315; 220/355; 70/271; 70/63; 221/15

[58] Field of Search ..... 220/211, 315, 355; 70/267, 271, 63; 368/10, 108; 221/15

[56] References Cited

U.S. PATENT DOCUMENTS

| | | | |
|---|---|---|---|
| 3,851,506 | 12/1974 | Simon | 70/63 |
| 4,361,408 | 11/1982 | Wirtschafter | 368/109 |
| 4,674,652 | 6/1987 | Aten et al. | 221/15 X |

FOREIGN PATENT DOCUMENTS

| | | | |
|---|---|---|---|
| 2240175 | 11/1973 | Fed. Rep. of Germany | 221/15 |
| 581677 | 9/1958 | Italy | 220/211 |
| 17972 | of 1898 | United Kingdom | 220/315 |

*Primary Examiner*—William I. Price

*Attorney, Agent, or Firm*—Malin, Haley, McHale, DiMaggio & Crosby

[57] ABSTRACT

Sealable food storage containers having a time actuated locking mechanism to prevent access to food stored except at a predetermined time. The purpose of the invention is to aid dieters, children and compulsive snack or dessert consuming persons by permitting access to a particular stored food only at a predetermined time. This is to prevent between meal snacks or consumption of foods for dietary reasons. The device includes a sealable plastic or other type of food storage container that can be safely used within a refrigerated space and a removable separate time actuated locking mechanism that can be interchanged and used with a variety of food storage containers. The time locking mechanism includes a lid latching mechanism that has an engageable latch that is disengaged at a predetermined time by an electrical current provided to a small motor. The food storage containers include a pouch or separate access chamber that houses the timing mechanism and cooperates with the lid for the locking mechanism. The device can also be used as a lockable storage container for school lunches so that children do not have access to the food until lunchtime.

1 Claim, 2 Drawing Sheets

TIME ACTUATED LOCKABLE FOOD STORAGE CONTAINER

BACKGROUND OF THE INVENTION

1. Field of the Invention

This invention relates to sealable food storage containers that can be locked for a set time period and specifically to food storage containers that are hermetically sealed to store food in a refrigerated or non-refrigerated environment and that include a time actuated locking mechanism that can be interchangeably used with a plurality of different food storage containers, especially useful for dieters or children.

2. Description of Prior Art

Time actuated locking mechanisms for storing various articles in a box are well known in the art. U.S. Pat. No. 3,851,506, issued to Simon, Dec. 3, 1974 shows a cigarette box that includes a self-contained locking mechanism that operates over a selected time period.

U.S. Pat. No. 4,361,408, issued to Wirtschafter, Nov. 3, 1982, shows a timer and alarm apparatus that is used for medication dispensing containers which houses a timing alarm to notify a person when a certain medication should be taken. A drug dispensing device is shown in U.S. Pat. No. 4,674,652, for time controlling and dispensing a particular drug as per a therapy routine in an unsupervised environment. This device includes a lockable storage container having a timing mechanism for dispensing the particular drug at a particular time. None of the devices shown in the prior art are appropriate or usable for storing perishable goods such as foods which must be hermetically sealed, if necessary, and refrigerated. Conventional plastic or rubber-like sealable storage containers have been marketed under the trademark of Tupperware and Rubbermaid. The present invention overcomes the problems of the prior art by providing a sealable food storage container that has an interchangeable time actuated locking mechanism to prevent unauthorized access to food in the container except at predetermined times. The device can be used as an aid for dieters and for children to prevent access to particular foods except at predetermined selected times. The interchangeable time lock mechanism can be used with a plurality of different sealable storage containers so that only one timing mechanism need be purchased for a plurality of containers of variable size, shape or particular use.

SUMMARY OF THE INVENTION

This invention is comprised of a plastic storage container for food that includes as separate components, a flat plastic lid having a groove disposed around the edges on one side which permit hermetic sealing of the lid to the plastic storage box, a timing mechanism that includes a latch releasing device and a separate latch locking mechanism for securing the lid to the rectangular storage container.

The food storage container as stated above, may be substantially rectangular and includes a raised lip around its perimeter which engages a groove in the lid to ensure a hermetic seal with the contents inside. The container and lid plastic material used is found today in conventional food storage devices that include sealed lids that are marketed under trademarks such as Rubbermaid and Tupperware. However the present invention is quite different than conventional food storage devices used at the present time as is more fully described herein.

The locking of the lid to the storage receptacle is achieved through the use of a latch locking mechanism and an electrically powered, timing lock releasing mechanism which cooperate together to lock the lid to the storage receptacle.

In order to accommodate and use the time-actuated lock release mechanism, the storage receptacle includes on one side a pouch or chamber that has an open bottom that permits the timing mechanism to be inserted therein from the bottom. In addition, the chamber includes a flat top surface having apertures (described below) that fits flushly with an extended lip mounted on one edge of the container lid. The lid also includes fasteners which allow the lid to be fastened along one side to ensure locking of the lid while at the same time in the unlocked position the lid can be completely removed from the food storage device for washing or total access to the food.

The latch locking mechanism includes a first flat surface having a hook shaped latch movably mounted under one side, preferably with a spring actuator, and a pair of downwardly positioned side panels. The other part of the latch locking mechanism includes separate flat planar surface with curved end portions which engage the latch locking mechanism through an aperture in its center so that the two parts, one including the latch, can be physically engaged together by spring tension, all of which are mounted above the lid lip and the timing mechanism chamber top in the locked position.

The timing mechanism includes a locking bar and a motor actuated eccentric cam that can be rotated to disengage the latch, moving it away from the locking bar which permits the entire locking mechanism to be disengaged therefore permitting the lid lip t be raised to permit access to the storage box.

The timing mechanism and the locking latch mechanism are completely removable from the food storage chamber and disengageable from the lid such that the entire time actuated locking mechanism may be used with a variety of different food storage containers. Because of the hermetic sealing and particular materials utilized, the device can be safely stored in the refrigerator or freezes without damage to the locking mechanism or the containers. The containers can be subjected to a dishwasher and microwave oven without the timer and lock.

To operate the device, the lid is removed and a particular food placed in the food storage box. The fasteners on one side of the lid are then engaged and the lid is closed in a hermetically sealed position. In this position the lip on the lid engages the upper surface of the timing mechanism chamber. The locking latch mechanism is then positioned downwardly passing through the lid lip and the upper chamber wall surface wherein the latch then engages the locking bar in the timing mechanism which has been previously inserted into the chamber. The timing mechanism may be set for release within a particular time period to be determined by the user, or could be used in conjunction with a clock mechanism that permits it to be opened at a particular predetermined time period.

Once the designated time has been reached in the timing mechanism, battery power through a circuit used in conjunction with the timer provides dc power to a small motor that rotates an eccentric cam positioned to engage the latch forcing the latch away from the locking bar causing the entire locking mechanism to spring upwardly permitting its removal from the lid lip. The lid can then be opened permitting access to the food stored inside.

Since the timing mechanism and the locking latch mechanism are completely removable from the device, leaving only a plastic housing, the storage container and the lid may be washed in a conventional manner without damaging the locking mechanisms.

Several containers could be stacked and locked together with the addition of a locking strap that wraps around the stacked array and engages the locking mechanism mounted in a single container.

It is an object of this invention to provide a device that is suitable for storing foods in a refrigerated environment that includes a time actuated locking mechanism that permits access to the food in the storage container only at a predetermined time.

It is another object of this invention to provide a device that aids dieters and parents in preventing access to certain refrigerable food stuffs by the dieter or children except at predetermined times.

Yet still another object of this invention is to provide a hermetically sealable, refrigerable food storage container that includes a removable and interchangeable timing mechanism and locking latch mechanism that can be utilized with a plurality of such food storage containers.

But yet still another object of this invention is to provide a food storage container that can be easily washed and cleaned and that also can receive a time actuated locking mechanism to prevent unauthorized access to the food therein except at predetermined times.

In accordance with these and other objects which will be apparent hereinafter, the instant invention will now be described with particular reference to the accompanying drawings.

PREFERRED EMBODIMENT OF THE INVENTION

Figure 1:
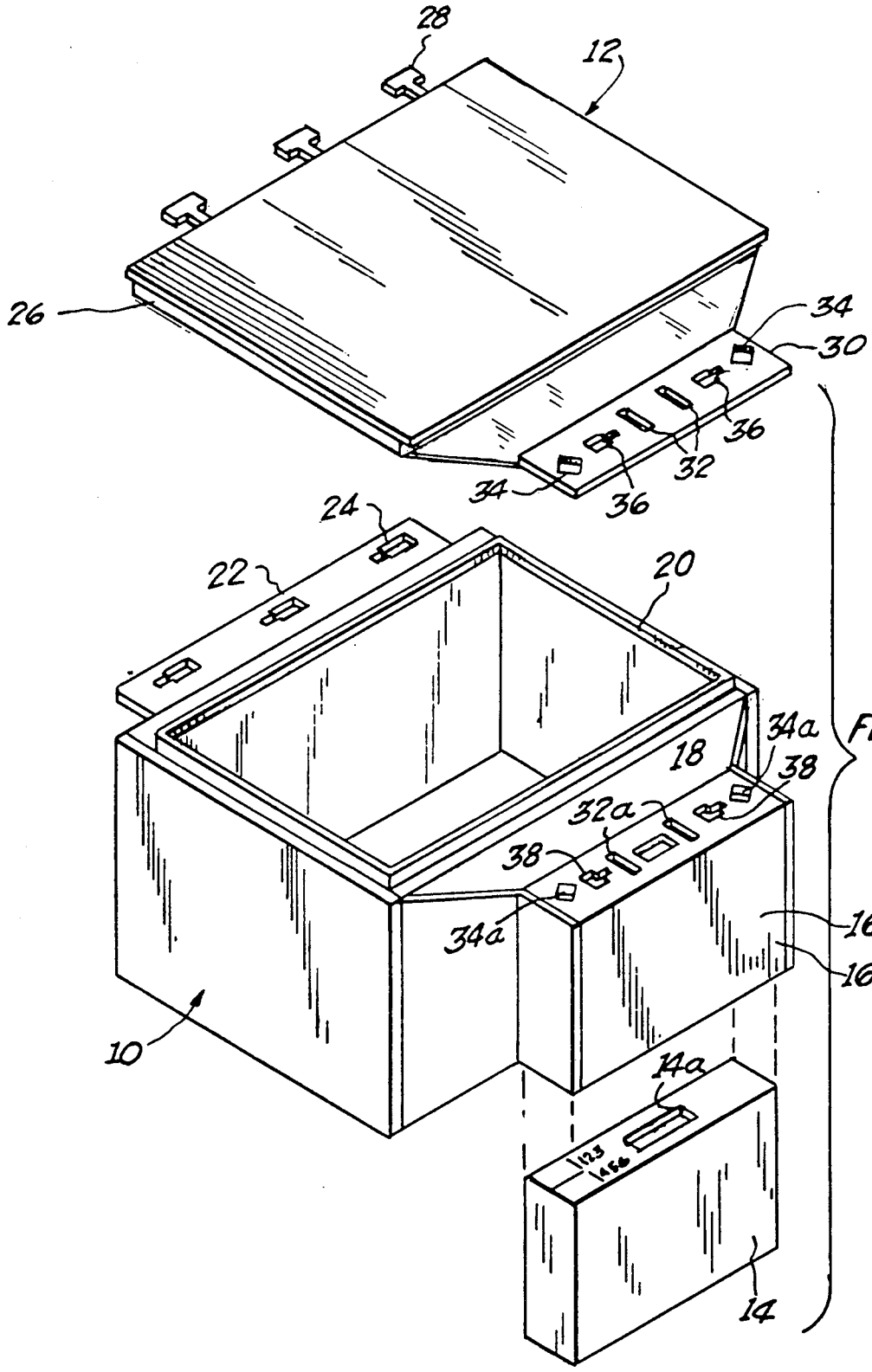
FIG. 1 shows an exploded view of the present invention that includes the food storage receptacle, lid and the timing mechanism.

Referring now to FIG. 1, the present invention is shown comprised of a rectangular food storage receptacle or box 10 that has a raised lip 20 around the perimeter of the top opening which can engage with a hermetically sealable lid 12, having correspondingly groove 26 disposed around one side that engages the lip 20 in the sealed position.

The storage receptacle 10 also includes a rectangular chamber 16 unitarily formed with the body of receptacle 10 that has an open bottom and an upper surface 18 including apertures 32*a* and 38 described below. A timing mechanism 14 is shown which may be inserted upwardly into the chamber 16.

The lid 12 includes a plurality of fasteners 28 which are received into apertures 24 on an extended lip 22 on one wall of the storage receptacle 10. Fasteners 28 are locked in groove apertures 24 to prevent the lid from being raised on that side of the storage receptacle.

The lid 12 also includes lip 30 extending from one downwardly positioned edge that includes apertures 34, 32 and 36 which are used to receive the locking mechanism described herein. The lip 3 in the locked position lies flush with the top surface 18 of chamber 16. Chamber 16 also includes a pair of ribs 16*a* on the inside, shown dotted, which act to hold the timing mechanism 14 firmly in chamber 16.

Figure 2:
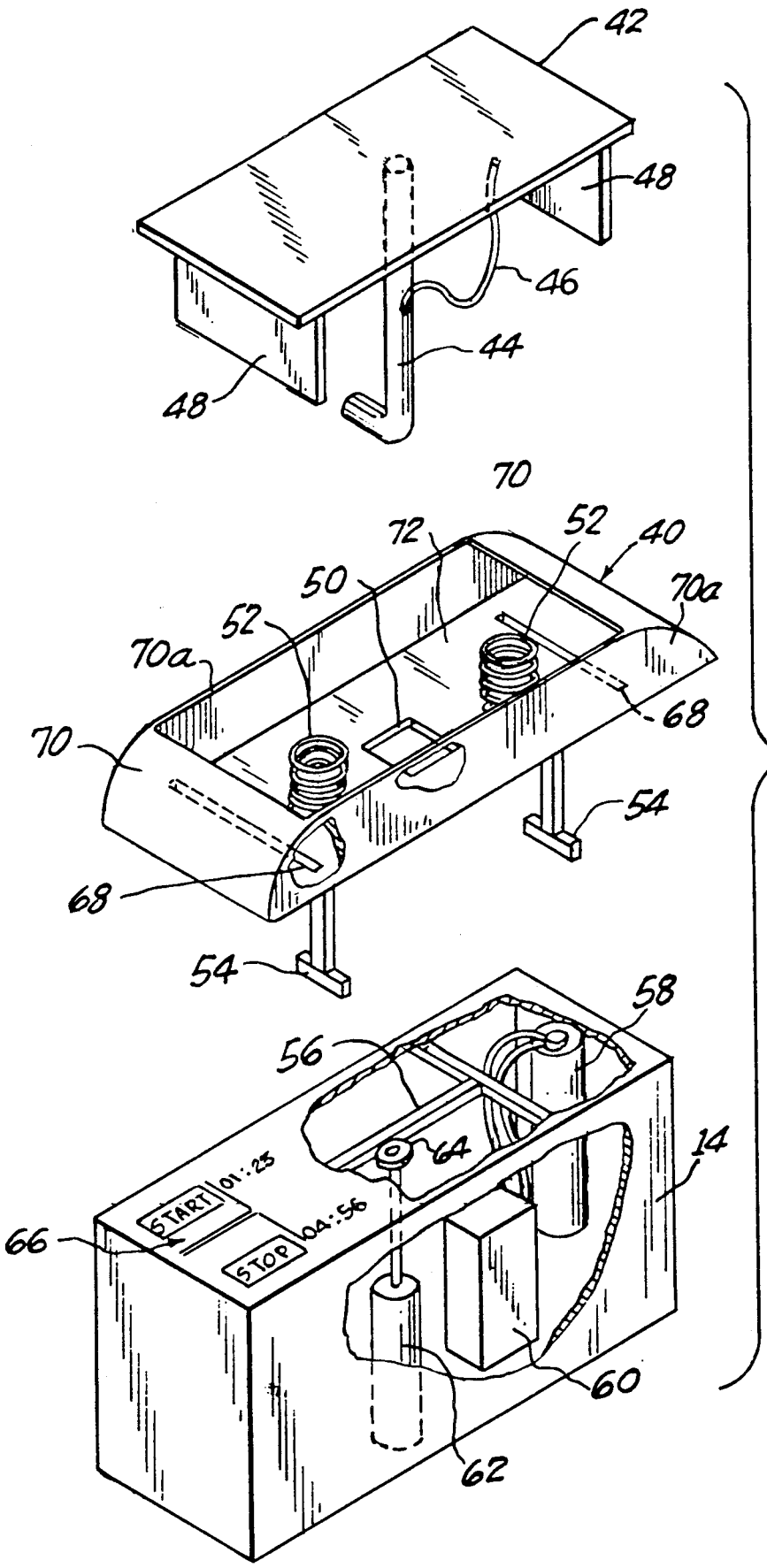
FIG. 2 shows an exploded view of the timing mechanism and the locking latch mechanism used in accordance with the present invention in perspective.

Referring now to FIG. 2, the latch locking mechanism is shown comprised of parts 42 and 40 which work in conjunction with a separate latch releasing timing mechanism 14.

The latch locking mechanism operates by combining parts 42 and part 40 so that the latch 44 is received through aperture 50 in the main body 72 of part 40. Part 40 also includes arcuate side walls 70 and straight side walls 70a protruding upwardly which hold part 42 in place against spring tension caused by springs 52 in the locking position. An additional spring 46 urges the pivotal latch 44 in a direction that in the locked position engages the locking bar 56 located in the timing housing 14. Part 40 also includes a pair of lateral slots 68 which receive the downwardly projecting side walls 48 in part 42. In the locked position, part 42 is engaged and fits flushly against part 40 with the latch 44 in a downward position, all of which is then positioned through the lid lip 30 and the upper surface 18 of chamber 16 which is rigidly formed as part of food storage receptacle 10. Protruding diamond shaped guides 34*a* fit into diamond shaped slots 34 in lid lip 30. Flanged legs 54 extending from part 40 are mounted through "T"-shaped lid apertures 36 and chamber top apertures 38 and moved laterally to retain part 40 to top 18 and to align slots 32 and 32*a* which receive side walls 48 in part 42. The side walls 48 pass through narrow rectangular slots 68 in part 40, narrow rectangular slots 32 in lid lip 30 and narrow rectangular slots 32*a* in chamber top 18 providing lateral stability for the locking mechanism preventing its removeable while firmly holding the lid lip 30 to chamber top 18 laterally. Part 40 is retained to chamber top 18 by the engagement of "T"-shaped legs 54 passing through lip lid apertures 36 and chamber top apertures 38 into side notches by slight lateral movement of part 40. In the locked configuration, latch 44 is engaged with bar 56, side walls 48 are retained in slots 32 and 32a and legs 54 are retained in slots 36 and 38. In this configuration the latch locking mechanism firmly locks the lid 12 to container 20 and can only be removed when latch 44 is disengaged from bar 56. Latch 44 engages the locking bar 56 in the timing housing such that the lid cannot be removed. After a preset amount of time (which is determined by the start and stop actuating mechanism in the timing mechanism 14), an elliptical eccentric cam 64 is rotated by motor 62 upon receipt of an electrical current through circuit 60 from battery 58. The eccentric cam 64 rotates and engages latch 44, moving it away from locking bar 56. Due to the spring tension from springs 52, the locking mechanism is forced upwardly away from the timing mechanism 14, releasing latch 44 so that the entire latching mechanism can be removed, allowing lid 12 to be removed.

For locking the device, the latching locking mechanism part 42 is positioned in conjunction with part 40 together by forcing the latch 44 down through lid lip 30 and the top surface 18. With spring tension from spring 46, the latch will engage the locking bar 56 causing the device to be locked.

Referring back to FIG. 1, the timing mechanism 14 can then be quickly removed from the device with the latch locking mechanism removed so that it can be used with other food storage containers having a similar structure to that shown in FIG. 1.

The circuitry used for the timing mechanism 14 is conventional and can either include a real time clock or a stop watch type timer set for a predetermined number of hours and minutes through a start and stop mechanism. The circuitry 60 which provides power to the motor 62 from battery 58 at predetermined times is known and conventional in nature.

Although the container has been shown as rectangular, other suitable and conventional shapes could be employed.

With the use of the present invention, dieters or children can be prevented access to particular stored foods in the receptacle except at predetermined times by proper setting of the time sequence desired in the timing mechanism.

The instant invention has been shown and described herein in what it is considered to be the most practical and preferred embodiment. It is recognized, however, that departures may be made therefrom within the scope of the invention and that obvious modifications will occur to a person skilled in the art.

What I claim is:

1. A food storage device which is hermetically sealable and which can prevent unauthorized access to foods stored in the device except at predetermined periods of time, comprising:

a receptacle for receiving food, said receptacle having a closed bottom end and open top end, said top end having a raised lip around its perimeter;

a removable lid that has a groove which fits over said receptacle raised lip to form a hermetic seal therebetween;

a chamber formed with said receptacle and mounted on the outside of said receptacle;

locking means mountable within said chamber for locking said lid to said receptacle;

an extending lip connected to said lid, said lip having at least one aperture;

said locking means comprising a first segment that includes a latch and a second segment that couples to said lip, and a third segment which houses a locking bar for engaging said latch; and timing means including an actuating means for disengaging said latch from said locking bar at a predetermined period of time, said timing means including a power source, whereby said first and second segments cooperate and engage said lid lip, coupling said first and second segments to said timing means.

* * * * *